US007696900B2

(12) United States Patent
Hall et al.

(10) Patent No.: US 7,696,900 B2
(45) Date of Patent: Apr. 13, 2010

(54) APPARATUS FOR RESPONDING TO AN ANOMALOUS CHANGE IN DOWNHOLE PRESSURE

(75) Inventors: David R. Hall, Provo, UT (US); Joe Fox, Spanish Fork, UT (US); Tyson Wilde, Aurora, CO (US); Jonathan S. Barlow, Sunnyvale, CA (US)

(73) Assignee: IntelliServ, Inc., Provo, UT (US)

( * ) Notice: Subject to any disclaimer, the term of this patent is extended or adjusted under 35 U.S.C. 154(b) by 40 days.

(21) Appl. No.: 12/030,444

(22) Filed: Feb. 13, 2008

(65) Prior Publication Data

US 2008/0135291 A1 Jun. 12, 2008

Related U.S. Application Data

(63) Continuation of application No. 10/711,796, filed on Oct. 6, 2004, now abandoned, which is a continuation-in-part of application No. 10/710,875, filed on Aug. 10, 2004, now Pat. No. 7,142,129.

(51) Int. Cl.
*G01V 3/00* (2006.01)

(52) U.S. Cl. ..... 340/853.7; 439/577; 439/191

(58) Field of Classification Search ..... 340/853.7, 340/854.9; 439/577, 191; 175/24
See application file for complete search history.

(56) References Cited

U.S. PATENT DOCUMENTS 4,297,880 A 11/1981 Berger
5,184,508 A 2/1993 Desbrandes
5,887,657 A 3/1999 Bussear et al.
5,934,371 A 8/1999 Bussear et al.
6,230,557 B1 5/2001 Ciglenec et al.
6,415,231 B1 7/2002 Hebert
6,415,877 B1 7/2002 Fincher et al.
6,648,081 B2 11/2003 Fincher et al.
6,659,197 B2 12/2003 Cooper
6,854,532 B2 2/2005 Fincher et al.
6,896,075 B2 5/2005 Haugen et al.
6,986,282 B2 1/2006 Ciglenec et al.
7,044,237 B2 5/2006 Leuchtenberg
7,062,959 B2 6/2006 Kurkjian et al.
7,082,821 B2 8/2006 Chen et al.

(Continued)

OTHER PUBLICATIONS

Smart Wells, J.D. Jansen, Jaarboek, Mijnbouwkundige Vereeniging, Feb. 2001.

*Primary Examiner*—Albert K Wong
(74) *Attorney, Agent, or Firm*—Victor Segura; Daniel P. Nelson

(57) ABSTRACT

A method of responding to an anomalous change in downhole pressure in a bore hole comprises detecting the anomalous change in downhole pressure, sending a signal along the segmented electromagnetic transmission path, receiving the signal, and performing a automated response. The anomalous change in downhole pressure is detected at a first location along a segmented electromagnetic transmission path, and the segmented electromagnetic transmission path is integrated into the tool string. The signal is received by at least one receiver in communication with the segmented electromagnetic transmission path. The automated response is performed along the tool string. Disclosed is an apparatus for responding to an anomalous change in downhole pressure in a downhole tool string, comprising a segmented electromagnetic transmission path connecting one or more receivers and at least one pressure sensor.

7 Claims, 7 Drawing Sheets

U.S. PATENT DOCUMENTS

| | | | |
|---|---|---|---|
| 7,096,975 | B2 | 8/2006 | Aronstam et al. |
| 7,114,581 | B2 | 10/2006 | Aronstam et al. |
| 7,172,037 | B2 | 2/2007 | Dashevskiy et al. |
| 7,174,975 | B2 | 2/2007 | Krueger et al. |
| 7,178,608 | B2 | 2/2007 | Mayes et al. |
| 7,201,221 | B2 | 4/2007 | Tubel et al. |
| 7,270,185 | B2 | 9/2007 | Fontana et al. |
| 7,284,903 | B2 | 10/2007 | Hartog |
| 7,311,142 | B2 | 12/2007 | Fisseler et al. |
| 7,353,887 | B2 | 4/2008 | Krueger et al. |
| 2002/0112888 | A1 | 8/2002 | Leuchtenberg |
| 2003/0066359 | A1 | 4/2003 | Gysling et al. |
| 2004/0025583 | A1 | 2/2004 | Kurkjian et al. |
| 2005/0024231 | A1 | 2/2005 | Fincher et al. |
| 2005/0092488 | A1 | 5/2005 | Rodet et al. |
| 2005/0194184 | A1 | 9/2005 | Gleitman |
| 2005/0194185 | A1 | 9/2005 | Gleitman |
| 2005/0200498 | A1 | 9/2005 | Gleitman |
| 2006/0157282 | A1 | 7/2006 | Tilton et al. |
| 2007/0007041 | A1 | 1/2007 | Krueger et al. |
| 2007/0039730 | A1 | 2/2007 | Fisseler et al. |
| 2007/0045006 | A1 | 3/2007 | Krueger et al. |
| 2007/0263488 | A1 | 11/2007 | Clark |
| 2007/0272033 | A9 | 11/2007 | Jones |
| 2008/0060846 | A1 | 3/2008 | Belcher et al. |

APPARATUS FOR RESPONDING TO AN ANOMALOUS CHANGE IN DOWNHOLE PRESSURE

CROSS REFERENCE TO RELATED APPLICATIONS

The present application is a continuation of U.S. patent application Ser. No. 10/711,796 filed on Oct. 6, 2004 now abandoned, the entire disclosure of which is incorporated by reference herein. Said application Ser. No. 10/711,796 is a continuation-in-part of U.S. patent application Ser. No. 10/710,875 filed on Aug. 10, 2004, now U.S. Pat. No. 7,142,129, which was incorporated by reference into application Ser. No. 10/711,796.

FEDERAL SPONSORSHIP

This invention was made with government support under Contract No. DE-FC26-01NT41229 awarded by the U.S. Department of Energy. The government has certain rights in the invention.

BACKGROUND OF THE INVENTION

The present invention relates to the field of prevention and protection against hazardous situations, particularly in a downhole network integrated into a drill string used in oil and gas exploration, or along the casings and other equipment used in oil and gas production.

Blowouts, high pressure kicks, and loss of circulation are a few of the dangers involved in exploration and production of oil and gas. Many systems have been developed to detect and control these dangers.

U.S. Pat. No. 4,377,206 discloses a device for preventing well blowouts in sucker rod pumping systems and particularly for sensing the parting of a polish rod from a stuffing box and preventing fluid flow through the stuffing box to the atmosphere. The device includes a wear block abutting against a polish rod for sensing when the polish rod parts from the stuffing box. When the polish rod parts from the stuffing box, a lever automatically causes a valve to rapidly close to prevent blowout of the fluid in the well bore.

U.S. Pat. No. 5,006,845 discloses methods for the early detection of gas kicks in marine risers which include monitoring a downhole absolute pressure and a downhole differential pressure of a riser section positioned just above a blowout preventor. Also disclosed is an apparatus comprising a means for telemetering said absolute pressure measurement and said differential pressure measurement from sensors connected to said instrumented riser section to control instrumentation positioned at said sea surface. Said means for telemetering may be an acoustic beacon.

U.S. Pat. Application No. 20040124009, to Hoteit et al., discloses a method and system for averting or mitigating undesirable drilling events during a drilling process. The state of the drilling rig is detected, preferably automatically, based on surface and/or downhole measurement data. One or more undesirable drilling events are detected by correlating the acquired measurement data with the detected state. A drilling rig action is determined which averts or mitigates a detected undesirable drilling event. Finally, the drilling process is overridden by commanding performance of the action.

U.S. application Ser. No. 10/878,243 filed Jun. 28, 2004 in the name of Hall, et al discloses a method and apparatus for use in assessing down-hole drilling conditions. The apparatus includes a drill string, a plurality of sensors, a computing device, and a down-hole network. The sensors are distributed along the length of the drill string and are capable of sensing localized down-hole conditions while drilling. The computing device analyzes data output by the sensors and representative of the sensed localized conditions to assess the down-hole drilling conditions. The method includes sensing localized drilling conditions at a plurality of points distributed along the length of a drill string during drilling operations; transmitting data representative of the sensed localized conditions to a predetermined location; and analyzing the transmitted data to assess the adverse down-hole drilling conditions. An application is also disclosed which may display a notice when some adverse drilling condition is about to occur and corrective or preventative action needs to be taken.

BRIEF SUMMARY OF THE INVENTION

A method of responding to an anomalous change in downhole pressure in a downhole tool string comprises detecting the anomalous change in downhole pressure, sending a signal along the segmented electromagnetic transmission path, receiving the signal, and performing an automated response. The anomalous change in downhole pressure is detected at a first location along a segmented electromagnetic transmission path, and the segmented electromagnetic transmission path is integrated into the tool string. The signal is received by at least one receiver in communication with the segmented electromagnetic transmission path. The automated response is performed along the tool string. The automated response is actuated at a second location on the tool string. Typically, the segmented electromagnetic transmission path comprises inductive couplers. Alternatively, the electromagnetic transmission path may comprise direct electrical contacts or optical couplers.

It should be noted that an integrated tool refers to a tool which comprises node circuitry, and a non-integrated tool refers to a tool that does not comprise node circuitry, but is in communication with a node.

The anomalous change in downhole pressure may be a pressure kick, a blowout, or loss of circulation, and is typically detected by at least one pressure sensor. Downhole pressure may be more than 15,000 psi in deep wells. Small changes of pressure may be a result of normal operation of the drilling rig, such as starting or stopping the flow of drilling fluid or tripping the drill string into or out of the hole. These normal changes in pressure may not cause a problem. An anomalous change in downhole pressure is therefore considered to be a significant change in downhole pressure such that the pressure may damage the drill string, endanger the safety of a surface crew, harm natural resources, or waste drilling fluid. The pressure sensor may be associated with a downhole node, an integrated tool, a non-integrated tool, or a bottom-hole assembly. Typically, the at least one pressure sensor is located near the bottom of the downhole tool string. Alternatively, the pressure sensors may be distributed along the tool string.

In general, the receiver may be a blowout preventor, a drilling fluid flow regulator, a computer, a router, a node, an actuator, or an alarm. The automated response may be actuating a blowout preventor, adjusting the flow of drilling fluid, or broadcasting an alarm. Typically the automated response is performed immediately upon receiving the signal. The automated response may be performed by the receiver.

Preferably, the method further comprises the step of actuating an action performing device by the receiver. The action performing device performs the automated response. The action performing device may be selected from the group consisting of a blowout preventor, a drilling fluid flow regulator, and an alarm. The action performing device may be located on the downhole tool string, in a well bore, near a well bore, or mounted on a drilling rig. An electrical connection, such as a wire, pair of twisted wires or coaxial cable may connect an action performing device, such as a blowout preventor, mounted in the well bore. Further optical fibers or infrared technology may be used to communication with the action performing device.

Disclosed is an apparatus for responding to an anomalous change in downhole pressure in a downhole tool string, comprising a segmented electromagnetic transmission path which comprises one or more downhole nodes. The downhole nodes comprise at least one receiver, and at least one pressure sensor. The segmented electromagnetic transmission path is integrated into the tool string, and the downhole nodes are spaced along the tool string. The at least one pressure sensor is in communication with the segmented electromagnetic transmission path, and the receiver is in communication with the pressure sensor via the segmented electromagnetic transmission path. The anomalous change in pressure is detected at one or more locations along the tool string and a automated response is performed at a second location along the drill string.

The at least one receiver may be a blowout preventor, a drilling fluid flow regulator, a computer, a router, an actuator, or an alarm. The apparatus may further comprise at least one action performing device. The automated response may be actuating a blowout preventor, adjusting the flow of drilling fluid, broadcasting an alarm, or sending an electronic message.

DETAILED DESCRIPTION OF THE INVENTION AND THE PREFERRED EMBODIMENT

The following detailed description of the invention and the preferred embodiment, in which like parts are labeled with like numerals, and the accompanying figures are intended to illustrate certain embodiments of the present invention and not to limit its scope in any way.

Figure 1:
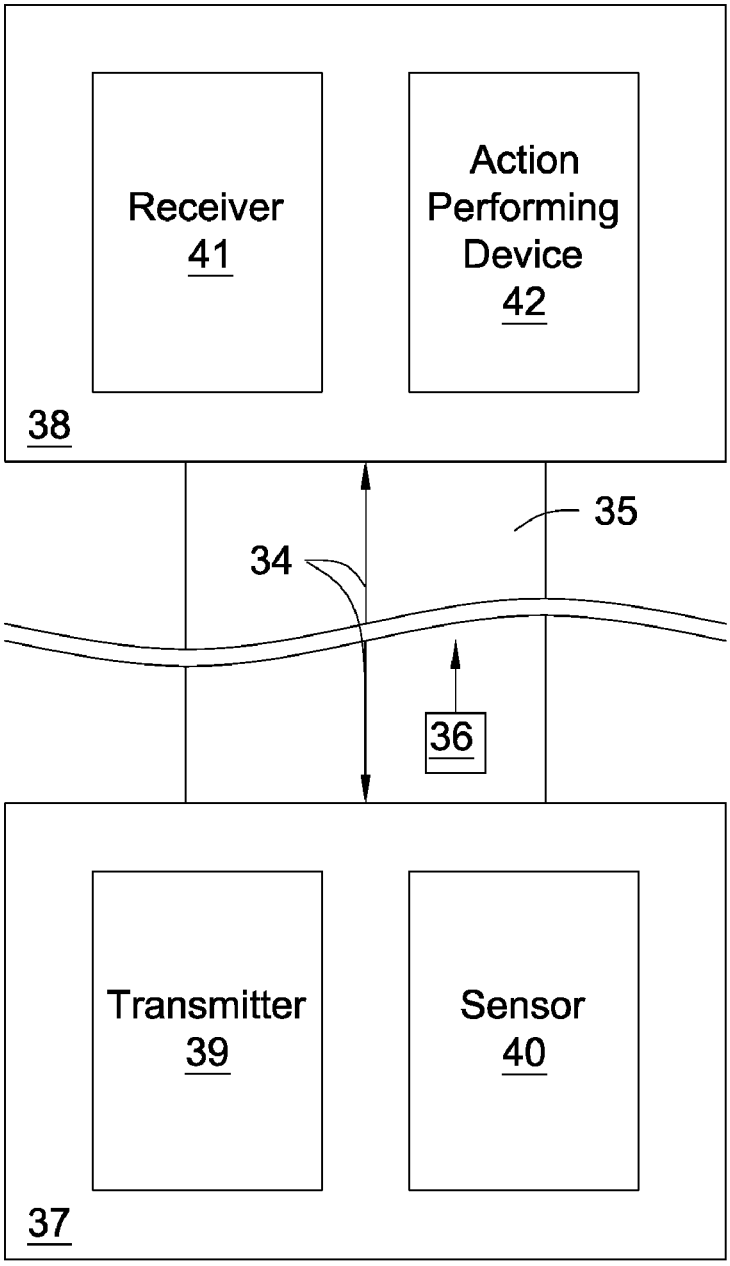
FIG. 1 is a functional block diagram of an apparatus having a pressure sensor and a receiver.

FIG. 1 is an apparatus for responding to an anomalous change in downhole pressure. The pressure sensor 37 comprises a sensor 40 for detecting an anomalous change in downhole pressure. The anomalous change in downhole pressure may be due to a change in drilling fluid pressure, as is the case in lost circulation. The anomalous change in downhole pressure may also be from high pressure released from the subterranean formations, which is typical in blowouts.

Some sensors 40 that may be used to detecting an anomalous change in downhole pressure are disclosed in U.S. Pat. Nos. 6,487,911, 4,696,192, and 4,444,060, the teachings of which are all herein incorporated by reference. Other suitable sensors may be used and may be obvious to those of ordinary skill in the art. The pressure sensor 37 further comprises a transmitter 39 for sending a signal 36 along the segmented electromagnetic transmission path 34 integrated into the downhole tool string 35. A downhole tool string 35 is preferably composed of segments of rigid pipe, but may alternately comprise sections of flexible pipe, or may be coiled tubing. A preferred system of transmitting a signal through a string of downhole components is described in U.S. Pat. No. 6,670,880 to Hall, et al., and related patents, which are herein incorporated by reference. Alternatively, the electromagnetic transmission path may comprise direct electrical contacts or optical couplers. Some other systems which may be compatible with the present invention are disclosed in U.S. Pat. No. 6,641,434, U.S. application Ser. No. 10/708,793 to Hall, et al.; U.S. Pat. No. 6,688,396 to Floerke, et al., and U.S. application Ser. No. 10/605,493 to Hall et al. which are herein incorporated by reference. The receiver 38 comprises a signal receiver 41 for receiving a signal 36. The receiver 38 also comprises an action performing device 42, which may be a blowout preventor, a drilling fluid flow regulator, a computer, a router, an actuator, or an alarm. An alarm may be a visual alarm such as a flashing light or an LED display displaying a warning message. Alternatively, an alarm may be an audio alarm, such as a buzzer, or a verbal warning message.

A blowout preventor may be ram-type blowout preventor, an annular blowout preventor, a coiled tubing blowout preventor, or a spherical blowout preventor. Some control systems which may actuate a blowout preventor are disclosed in U.S. Pat. Nos. 3,552,502, 4,614,148, 6,032,742, and 6,484,806 and are all herein incorporated by reference. These control systems typically actuate a blowout preventor in response to commands from a human operator or to conditions near the surface of the earth such as drilling fluid flowing out of the well bore. These control systems may be adapted according to the present invention to receive a signal 36 from a fluid pressure sensor 37 and actuate the blowout preventor. Alternately, these control systems may be adapted to be controlled by a receiver 38 directly. Typically, a blowout preventor may be closed by hydraulic cylinders, which may be controlled via the opening and closing of a hydraulic supply line. The opening and closing of a hydraulic supply line may be controlled using an electrically operated valve, which may be fitted with electronic circuitry. The electronic circuitry may be in electrical communication with the transmission path 34, and may be adapted to receive the signal 36 and open the hydraulic fluid supply line, thereby actuating the blowout preventor. Alternatively, the electronic circuitry may receive a command to actuate from a receiver 38 such as a node, a router or a computer. An example of a blowout preventor with hydraulic actuators is a ram-type blowout preventor. A ram-type blowout preventor may be capable of withstanding 15,000 psi, and may be installed on the casing head. The ram-type blowout preventor may be wired such that electrically operated valves respond to a signal originating downhole indicating a blowout. As the electrically operated valves open, fluid enters a chamber and pushes the hydraulic cylinders, which forces two halves of a well bore cover together to seal the well bore. These two halves may be designed to close over an open hole, close around a drill string 35, or cut through a drill string 35. A ram-type blowout preventor may be named according to the design of the two halves. A blind ram-type blowout preventor may be designed to close over an open well bore, a variable bore ram or variable bore pipe ram-type blowout preventor may be designed to close over a drill string 35 within a manufacturer specified range of diameters, and a shear ram-type blowout preventor may be designed to cut through a drill string 35.

A drilling fluid flow regulator may be a pump, which may pump drilling fluid into or out of the well bore. A pump may be used in situations such as loss of circulation, where the flow of drilling fluid may be halted to prevent further loss of drilling fluid. Many pumps 46, FIG. 4, known in the art are suitable for pumping drilling fluid into or out of a well bore. Alternately, a drilling fluid flow regulator may be an electrically operated shutoff valve located within the tool string, which may close to restrict the flow of drilling fluid. An electrically operated shutoff valve which may be adapted to the present invention by wiring the shutoff valve to respond to a downhole signal 36 by opening or closing is disclosed in U.S. Pat. No. 3,477,526 to Jones, et al. Nov. 11, 1969 and is herein incorporated by reference.

Figure 2:
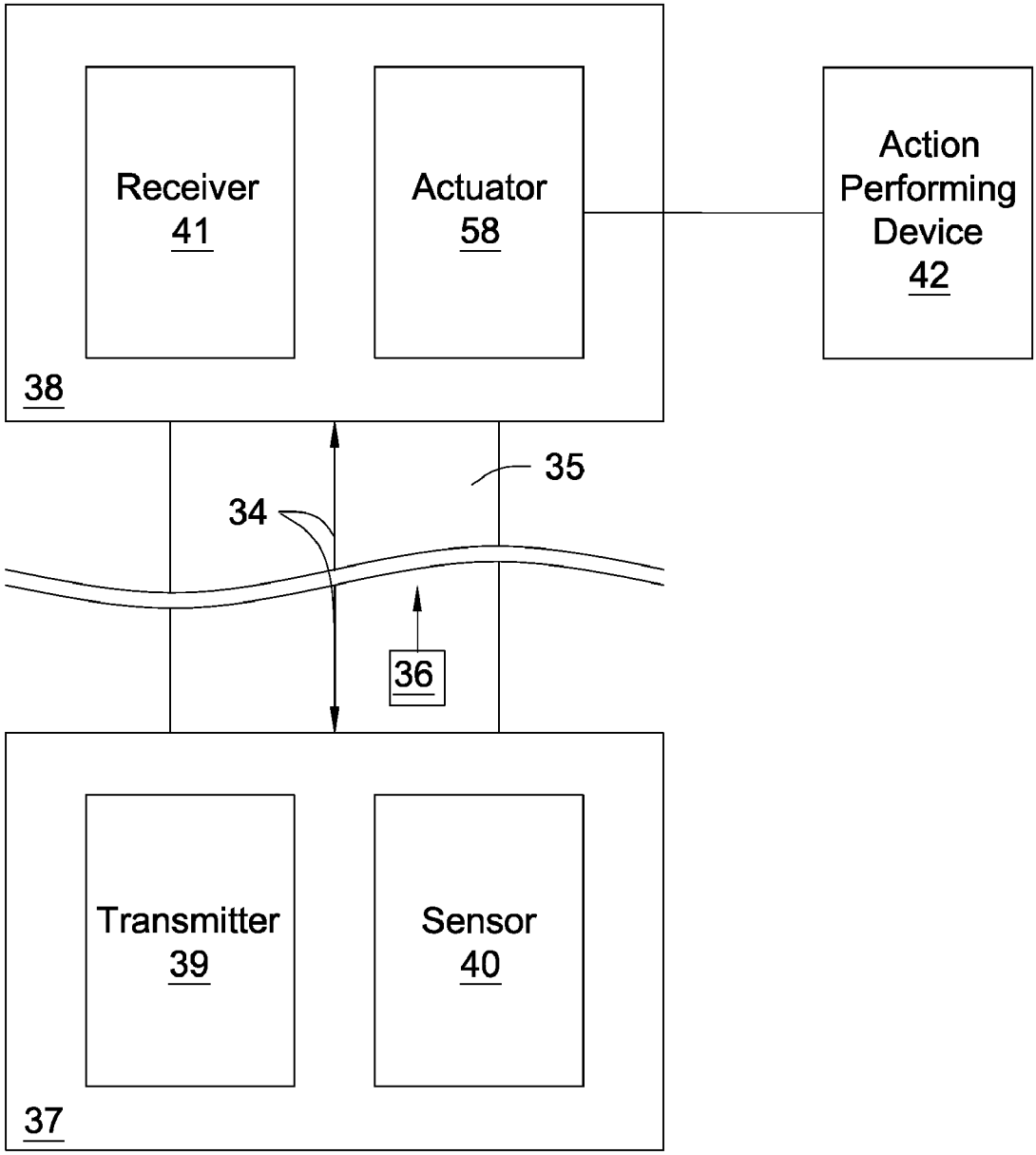
FIG. 2 is a functional block diagram of an apparatus having a pressure sensor a receiver, and an action performing device.

FIG. 2 is an apparatus for responding to an anomalous change in downhole pressure. The pressure sensor 37 comprises a sensor 40 for detecting an anomalous change in downhole pressure and a transmitter 39 for sending a signal 36 along the segmented electromagnetic transmission path 34 in the downhole tool string 35. The receiver 38 comprises a signal receiver 41 for receiving a signal 36. This apparatus differs from the apparatus shown in FIG. 1 in that the receiver 38 further comprises an actuator 58 for actuating an action performing device 42. The action performing device 42 may be a blowout preventor, a drilling fluid flow regulator, and an alarm. The receiver 38 may be a router and may be in communication with many action performing devices 42. The router may route the signal 36 to one or more of the action performing devices 42. For example, the signal 36 may be a packet having a destination address, and the router may route the signal 36 to the appropriate action performing device 42. Alternatively, the signal 36 may contain information about the anomalous change in downhole pressure, and the router may have control circuitry which interprets the downhole condition from the signal 36 and routes the signal to the appropriate action performing devices 42.

Figure 3:
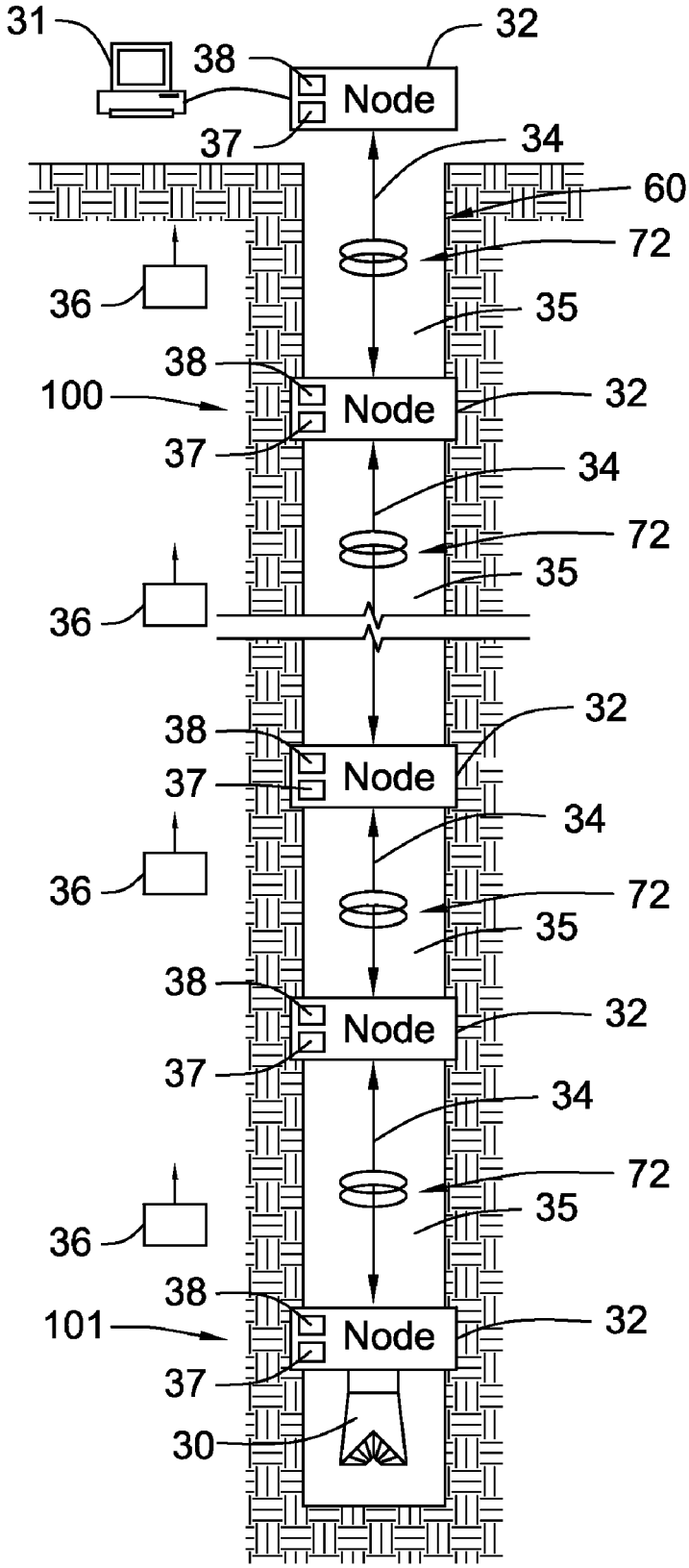
FIG. 3 is a diagram of an apparatus having a plurality of nodes.

FIG. 3 is a diagram of an apparatus for responding to an anomalous change in downhole pressure in a downhole tool string 35. The apparatus comprises a segmented electromagnetic transmission path 34 which comprises multiple downhole nodes 32 and is integrated into the downhole tool string 35. The nodes 32 may be as complex as the nodes discussed in U.S. patent application Ser. No. 10/710,790, entitled "Distributed Downhole Drilling Network," and filed Aug. 3, 2004 in the name of David Hall, et. al. The nodes 32 may alternately be as simple as a network interface modem or control logic for interfacing with a network. The pressure sensor may be located near the bottom of the tool string 35 at a first location 100 and the receiver may be located near the top of the tool string 35 at a second location 101 where the automated response may take place. The first and second locations 100, 101 may both be located downhole. The first and second locations 100, 101 may also be immediately adjacent one another.

Typically, the electromagnetic transmission path comprises inductive couplers 72. The inductive couplers 72 may allow electromagnetic signals to be transmitted across joints of a segmented tool string. The transmission of electromagnetic signals may permit the signal 36 to move rapidly through the tools string, and may allow the signal 36 to reach the receiver 38 in time to react to the anomalous change in downhole pressure. For example, the signal 36 may be able to notify the receiver 38 of a blowout before the drilling fluid or tool string is ejected from the well bore. In this embodiment, a computer 31 is also in communication with the transmission path 34.

Each downhole node 32 may comprise a fluid pressure sensor 37 and a receiver 38. This may be advantageous during tripping. When the tool string 35 is first put in the well bore, it may be advantageous to have a first node 32 containing a receiver 38 near the surface of the earth where it may actuate an action performing device 42 (see FIG. 2) on the surface of the earth. As the well bore becomes deeper, and sections of pipe are added above the node 32, it may be more than 300 feet below the surface of the earth. The receiver 38 may communicate with the action performing device 42 over a direct electrical connection, or by a wireless transmitter. Because the wireless transmitter may have a limited range, and a cable may have a limited length, the receiver may need to be within a certain distance from the action performing device 42. It may therefore be advantageous to have another node 32 which may be added to the tool string 35 and may be located closer to the surface of the earth, and which may comprise a receiver 38. In this way, it may be possible to maintain the ability to actuate an action performing device 42 wirelessly without removing and replacing the node 32 each time a new section of pipe is to be added to the tool string 35. Some downhole nodes 32 may have only a fluid pressure sensor 37 or only a receiver 38, or neither.

The arrangement of pressure sensors 37 and receivers 38 in the downhole tool string may depend on specific considerations. One arrangement may comprise one pressure sensor 37 in a bottom-hole assembly to detect an anomalous change in downhole pressure, and one receiver 38 in a node 32 near the top of the tool string 35. Such an arrangement may have the advantage of being simple and therefore cost effective. Another arrangement may have multiple bottom pressure sensors 37 located in a bottom-hole assembly. Such an arrangement may provide a redundant system and may protect against the failure of one or more of the sensors 37. Another arrangement may have multiple pressure sensors 37 spread along the downhole tool string 35 which may also provide redundant detection in case one or more sensors 37 fail. Such an arrangement may also be able to track the speed and progress of the anomalous change along the downhole tool string 35, and reveal the behavior of the anomalous change. The at least one pressure sensor 37 may be a downhole node 32, an integrated tool, a non-integrated tool, or a bottom-hole assembly 30, and is preferably located near the bottom of the downhole tool string 35.

The fluid pressure sensor 37 is in communication with the receiver 38 via the transmission path 34. The fluid pressure sensor 37 may send a signal 36 to the receiver 38. The at least one receiver 38 may be a blowout preventor, a drilling fluid flow regulator, a computer, a router, a node, an actuator, or an alarm.

For example, a pressure surge may be detected in the bottom-hole assembly 30. A pressure surge may increase downhole pressure over 9,000 psi.

The fluid pressure sensor 37 may send a signal 36 indicating an anomalous change to a receiver 38, such as a blowout. The receiver 38 may be a blowout preventor, and may close upon receiving the signal 36 to prevent a blowout. There may be several receivers 38 at several points on the downhole tool string 35, which may perform various functions in response to the signal 36. Continuing the example, one receiver 38 may be a drilling fluid flow regulator, which may stop the flow of drilling fluid in preparation for the blowout. Alternately, there may be one receiver 38 which may be a node 32 or a router, which may then actuate a blowout preventor and the drilling fluid flow regulator.

Figure 4:
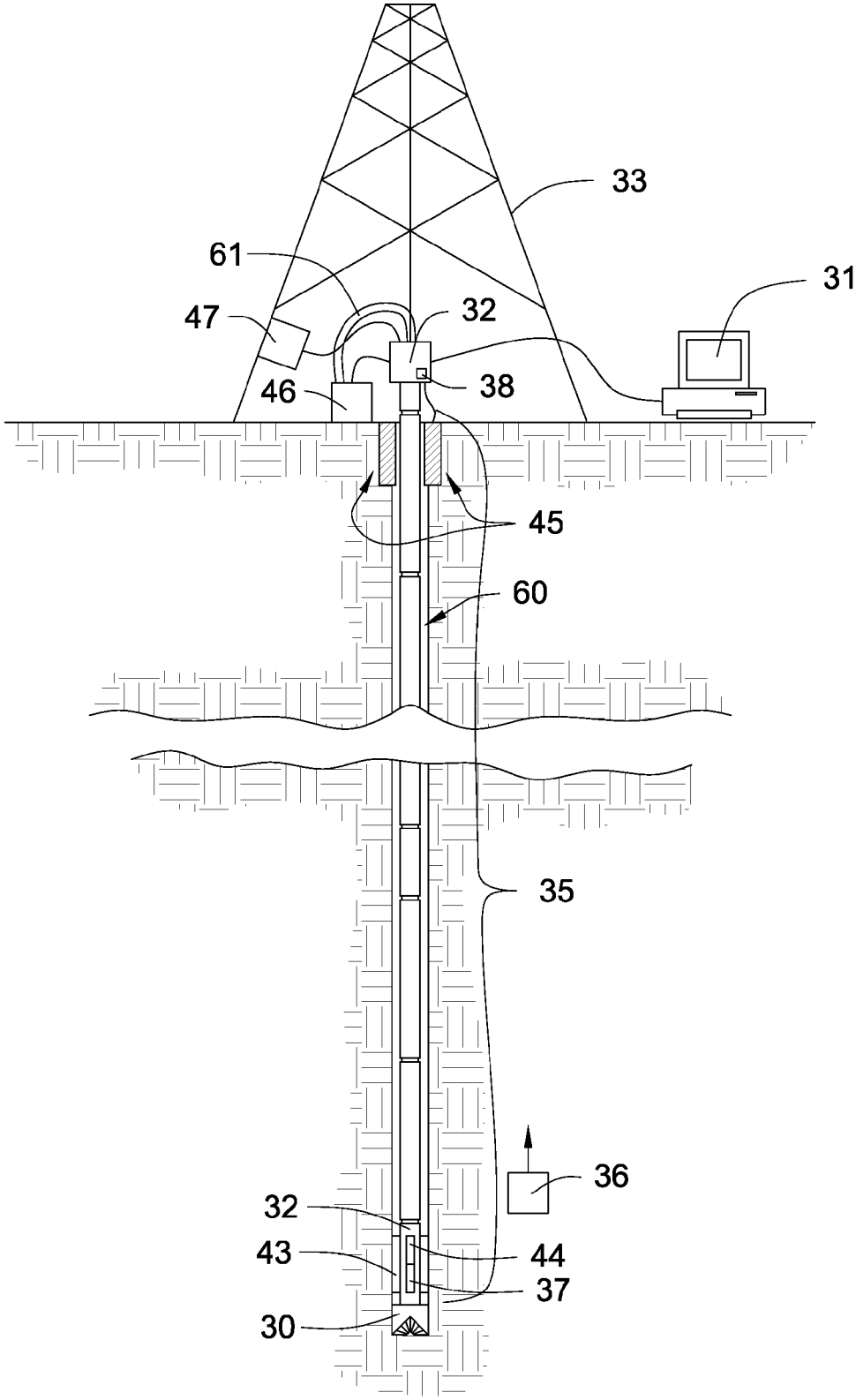
FIG. 4 is a diagram of an apparatus having multiple action performing devices.

FIG. 4 is a diagram of an apparatus for responding to an anomalous change in downhole pressure in a downhole tool string 35. The downhole tool string 35 may comprise several nodes 32. The receiver 38 may be a portion of a node 32, and is in communication with action performing devices such as a computer 31, an alarm 47 mounted on a drilling rig 33, a drilling fluid flow regulator 46 near the surface of a well bore 60, and a blowout preventor 45 in the well bore 60. The flow regulator 46 may be a pump and may control the flow of drilling fluid into and out of the well bore 60 by increasing or decreasing the rate at which the fluid is pumped into the well bore 60 or by pumping drilling fluid out of the well bore. The pump 46 may be in fluid communication with the tool string 35 via a hose 61. The pump 46 may be controlled by the receiver 38, or it may comprise additional circuitry for receiving and processing the signal 36.

The fluid pressure sensor 37 may be a portion of an integrated tool 44 in a node 32 which also comprises a non-integrated tool 43 and is located near the downhole bottom-hole assembly 30. The pressure sensor 37 is adapted to detect an anomalous change in downhole pressure which may be a pressure kick, a blowout, or loss of circulation. For example, the pressure sensor 37 may detect a sudden increase in downhole pressure, which may indicate a sudden increase in overall pressure downhole and which may be a high pressure kick or a blowout. A sudden increase in downhole pressure may be caused by a pocket of highly pressurized oil or gas contacting the well bore. Alternatively, the pressure sensor 37 may detect a sudden decrease in downhole pressure, which may indicate a loss of circulation. A loss of circulation may be caused by an underground cavern, which may be formed in limestone, and may provide an area into which the drilling fluid may escape. The pressure sensor 37 is also adapted to send a signal 36 to the receiver 38 via the electromagnetic transmission path 34 as seen previously. The receiver 38 is adapted to actuate one or more of the action performing devices 31, 47, 46, 45, which may perform an automated response such as actuating a blowout preventor, adjusting the flow of drilling fluid, or broadcasting an alarm. In alternative embodiments, the receiver 38 may be a computer, an alarm, a drilling fluid flow regulator, or a blowout preventor, and may perform the automated response itself.

Figure 5:
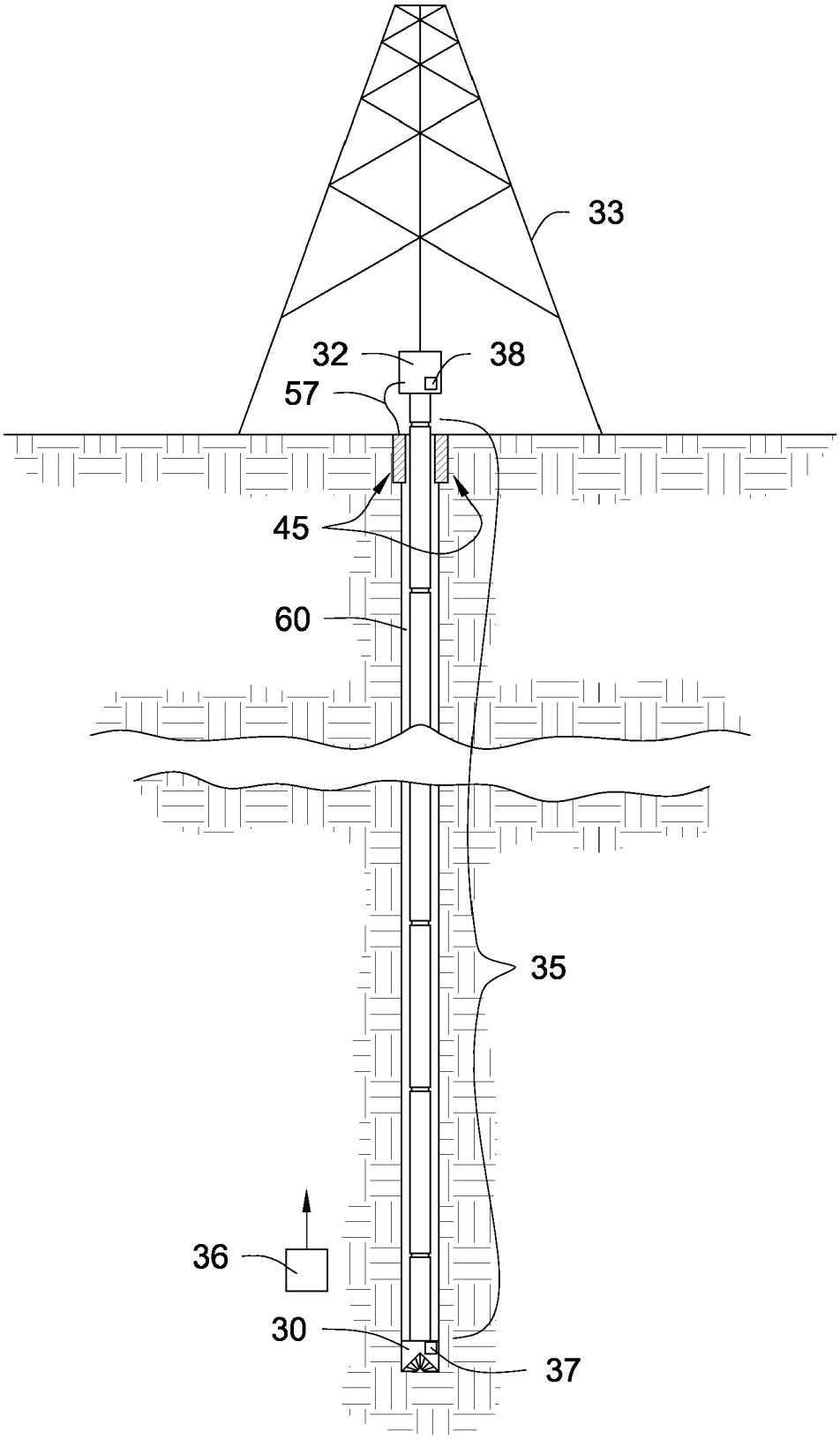
FIG. 5 is a diagram of an apparatus for responding to an anomalous change in downhole pressure.

FIG. 5 is the preferred embodiment of an apparatus for responding to an anomalous change in downhole pressure in a downhole tool string 35. The apparatus comprises an electromagnetic transmission path 34 (shown previously) which comprises a node 32. The node 32 comprises a receiver 38 which is in communication with a blowout preventor 45, and the downhole bottom-hole assembly 30 comprises a fluid pressure sensor 37, and is at the bottom of the downhole tool string 35. The fluid pressure sensor 37 is in communication with the receiver 38 via the electromagnetic transmission path 34, and is adapted to send a signal 36 to the receiver 38 via the electromagnetic transmission path 34. The anomalous change in fluid pressure is preferably detected at the downhole bottom-hole assembly 30. The anomalous change in downhole pressure may be a pressure kick, or a blowout. The receiver 38 may be a computer, a router, or an actuator, and is typically adapted to actuate the blowout preventor 45. The blowout preventor 45 is located in the well bore 60, but may also be on the downhole tool string 35, near a well bore 60, or mounted on a drilling rig 33. The location of the blowout preventor 45 will generally depend on the type of blowout preventor 45 used. The blowout preventor 45 may be a ram-type blowout preventor, an annular blowout preventor, a coiled tubing blowout preventor, or a spherical blowout preventor. A connection 57 such as a wire or a pair of wireless transceivers may be provided between the receiver 38 and the blowout preventor 45, which may be exclusively for actuating the blowout preventor.

Figure 6:
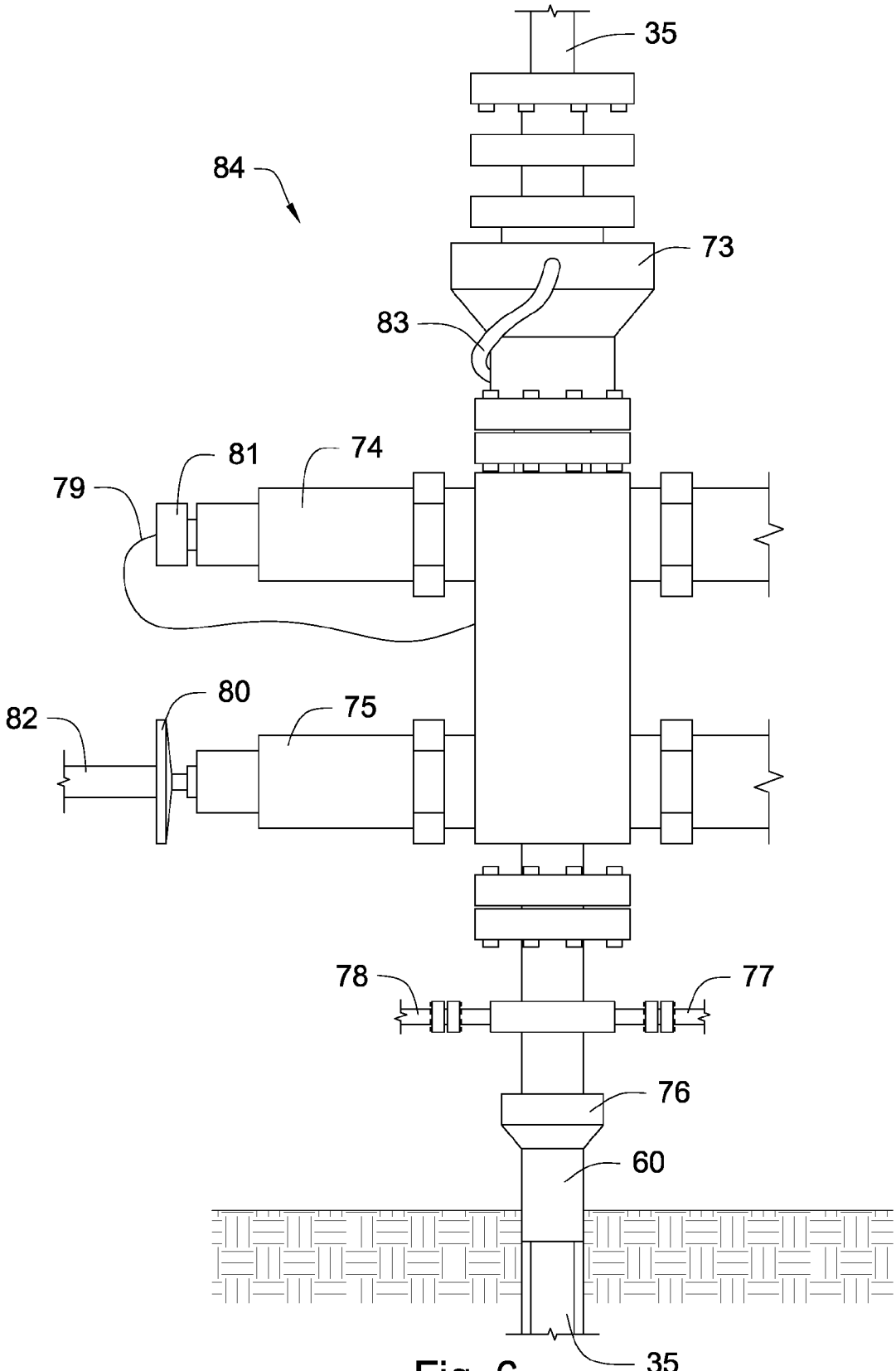
FIG. 6 is a perspective diagram of a blowout preventor stack.

FIG. 6 illustrates a perspective view of a blowout preventor stack 84 attached to a well head casing 76. A well head casing 76 is typically attached to a cement lining in a well bore 60, and access to the well bore 60 is typically through the well head casing 76. Typically a tool string 35 is inserted through the blowout preventor stack 84. A blowout preventor stack 84 may comprise multiple blowout preventors 73, 74, 75 such as an annular blowout preventor 73, blind ram-type blowout preventor 74, and shear ram-type blowout preventor 75. In the prior art, blowout preventors may be operated by hand values, which when rotated allows fluid to push against hydraulic cylinders (located in the blowout preventors 74 and 75 and are not shown) which forces the hydraulic cylinders to close. The present invention may also comprise blowout preventors 73, 74, 75 with hand valves 81 as a secondary means to activating a blowout preventor 73, 74, 75. Preferably, the hand valve 80 may be replaced by an electrically closing valve 81, which may be operated through an electrical connection 57 as was discussed in connection with FIG. 5. This electrical connection 57 may be a wire 79, which may be secured along a blowout preventor or along other pipes or tubing along the blowout preventor stack 84. This may be advantageous in keeping the wire 79 from being tangled in equipment or obstructing workers or equipment.

Alternatively, a mechanical device such as a pipe 82 may be bolted or otherwise attached to a hand valve 80 and rotated with an electric motor (not shown) to close the blowout preventor 75. The electric motor may then be controlled by a receiver 38 (shown previously). The pipe 82 may allow traditional blowout preventors with hand valves 80 to be used with the present invention without significant modification.

In another embodiment, an annular blowout preventor 73 may be actuated by a receiver 38 controlling a voltage supplied to an electric motor (not shown) of a fluid pump (not shown). The hydraulic fluid pump may pump fluid through a tube 83 to a blowout preventor such as an annular blowout preventor 73. Many blowout preventors commonly known in the art may be controlled via one or more tubes 83. The voltage supplied to the motor may be controlled by a receiver 38 supplying or not supplying the voltage directly. Alternatively, the voltage may be controlled by a receiving device selecting whether or not a voltage supply is connected to the electric motor. The tube 83 may be secured along the blowout preventor stack 84 or along other pipes or tubing along the blowout preventor 84 to prevent the tube 83 from being pinched, cut, or obstructing workers or equipment. Actuating blowout preventors 73, 74, 75 by controlling a voltage supplied to an electric motor of a fluid pump may be advantageous as many blowout preventors which may be controlled via one or more tubes 83, and such blowout preventors 73, 74, 75 may be used with the present invention without modifying the blowout preventors 73, 74, 75, the tubes 83, or the electric motor.

A choke line 77 and a kill line 78 may also be provided, and may allow fluid to flow out of or into the well bore respectively. These may be attached to a drilling fluid flow regulator 46 discussed in FIG. 4.

Figure 7:
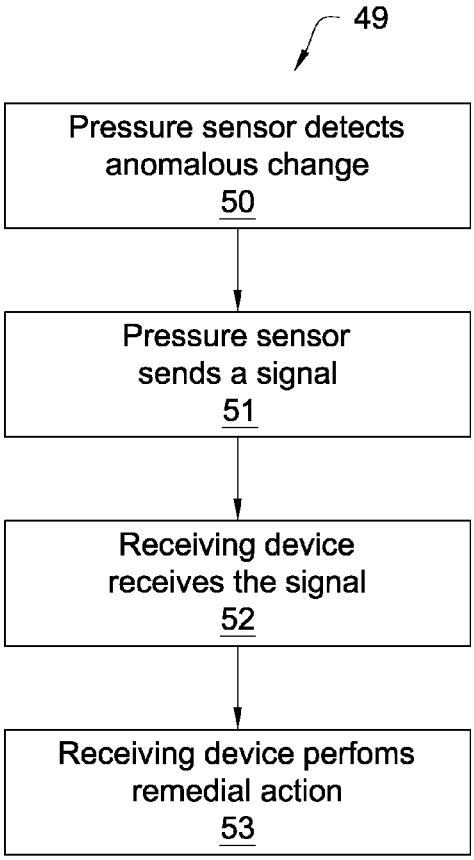
FIG. 7 is a flowchart of a method of responding to an anomalous change in downhole pressure.

FIG. 7 illustrates a method 49 of responding to an anomalous change in downhole pressure in a downhole tool string 35 and references FIG. 4. In step 50 a downhole pressure sensor 37 detects an anomalous change in downhole pressure at a first location 100 along an electromagnetic transmission path 34 (seen in FIG. 3). The first location 100 may be at the downhole pressure sensor 37.

The fluid pressure sensor 37 may be a downhole node 32, an integrated tool 44, a non-integrated tool 43, or a bottom-hole assembly 30. Typically, a fluid pressure sensor 37 may be located near the bottom of the downhole tool string 35.

In step 51 the pressure sensor 37 sends a signal 36 along the electromagnetic transmission path 34. The electromagnetic transmission path 34 is integrated into the tool string 35. The signal 36 may override any function that the transmission path 34 may be performing. Alternatively, the signal 36 may be distinguishable from other signals on the transmission path 34, or may require special handling by the transmission path 34. For example, the transmission path 34 may be a portion of a network, which may have any network protocol known in the art. The signal 36 may break network protocol and be handled to the exclusion of other network functions. Alternatively, the network may function over certain frequencies or during certain periods of time, and the signal 36 may use a dedicated or otherwise unused frequency or period of time in order to transmit. Thus, the signal 36 may be distinguished by the network and handled differently than usual signals. Preferably, the signal 36 is handled as quickly as possible so that the anomalous change also may be handled as quickly as possible. For example, a network may operate within a certain bandwidth of frequencies, and a frequency outside of the operating bandwidth of the network may be used for the signal 36.

In step 52 the receiver 38 receives the signal 36. There may be multiple receivers 38, either near the surface of the well bore 60, or distributed along the downhole tool string 35 which may allow multiple automated responses to be performed along the downhole tool string 35.

For example, in marine drilling, there may be a blowout preventor or fluid control devices located at the seabed as well as on drilling platform. Multiple receivers 38 may be near the seabed and drilling platform which may communicate with the blowout preventors and control devices. A receiver near the seabed allows a quicker response by the seabed blowout preventor yet the platform equipment may also receive the signal 36. An electrically actuated sub sea blowout preventor compatible with the present invention is disclosed in U.S. Pat. No. 6,484,806 to Childers, et al.

In step 53 the receiver 38 performs an automated response. The automated response may be actuating a blowout preventor, adjusting the flow of drilling fluid, or broadcasting an alarm. Typically the automated response is performed immediately upon receiving the signal. Performing the action immediately upon receiving the signal may have the advantage of reducing human error by eliminating the need for an operator. As previously discussed, the signal 36 may be able to notify the receiver 38 of a blowout before the drilling fluid or tool string is ejected from the well bore 60. Performing the action, such as sounding an alarm or actuating a blowout preventor may alert workers faster and may lessen damage to rig, equipment, and people.

Figure 8:
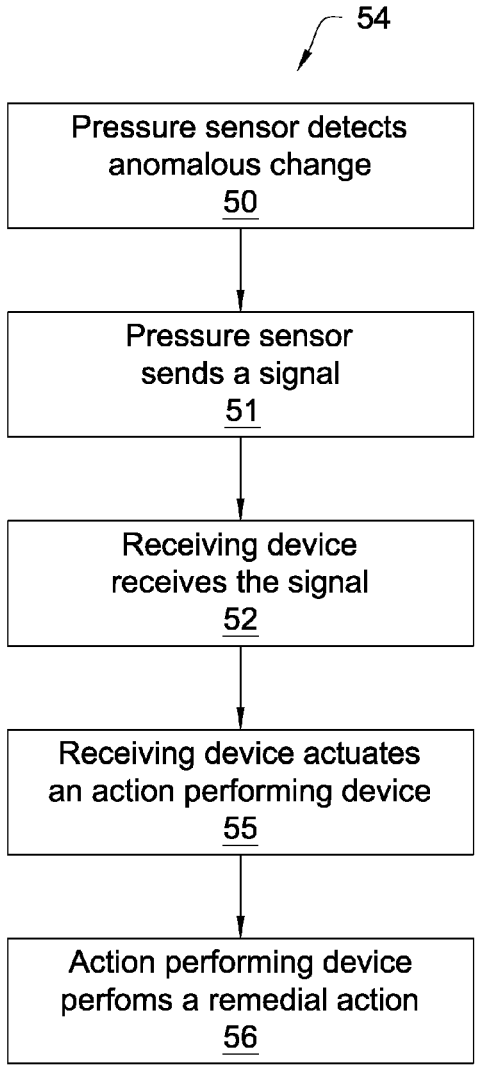
FIG. 8 is a flowchart of a method of responding to an anomalous change in downhole pressure.

FIG. 8 is a flowchart of a method 54 of responding to an anomalous change in downhole pressure in a downhole tool string 35 and references FIG. 4. This method 54 comprises the steps 50 through 52 from the method 49 in FIG. 6 discussed previously. This method 54 further comprises the steps 55 and 56. In step 55, the receiver 38 actuates an action performing device 42. In step 56 the action performing device 42 performs an automated response. The automated response may be actuating a blowout preventor, adjusting the flow of drilling fluid, or broadcasting an alarm. There may be multiple action performing devices 42 which may be actuated by one or more receivers 38 as discussed previously.

Whereas the present invention has been described in particular relation to the drawings attached hereto, it should be understood that other and further modifications apart from those shown or suggested herein, may be made within the scope and spirit of the present invention.

What is claimed is:

1. A method for responding to an anomalous change in downhole pressure in a borehole, comprising:

providing multiple pressure sensors mounted along a tool string configured to drill a borehole through a subsurface formation, each pressure sensor communicating with a wire path integrated into the tool string and configured to send a signal indicative of a detected pressure change along the wire path;

tracking pressure changes along the tool string with signals sent by the pressure sensors along the wire path;

receiving the signals with at least one receiver communicating with the wire path;

determining the speed of detected pressure changes along the tool string from the signals; and performing, by the at least one receiver, an automated function in response to the detected pressure changes indicated by the signals.

2. The method of claim 1, wherein the at least one receiver is selected from the group consisting of a blowout preventor, a drilling fluid flow regulator, a computer, a router, a node, an actuator, and an alarm.

3. The method of claim 1, wherein the automated function is selected from the group consisting of actuating a blowout preventor, adjusting the flow of drilling fluid, and activating an alarm.

4. The method of claim 1, further comprising actuating an action performing device by the at least one receiver.

5. The method of claim 1, further comprising establishing a communication link between the at least one receiver and an action performing device disposed on the earth's surface.

6. The method of claim 5, wherein the at least one receiver is configured to communicate with the action performing device via at least one of a direct electrical connection and a wireless connection.

7. The method of claim 1, further comprising performing multiple automated functions in response to signals indicative of detected pressure changes received at a plurality of receivers disposed along the tool string.

* * * * *